US008297915B2

(12) United States Patent
Kang et al.

(10) Patent No.: US 8,297,915 B2
(45) Date of Patent: Oct. 30, 2012

(54) REAL-TIME TURBOMACHINERY BLADE BREAKAGE MONITORING UNIT AND TURBO-APPARATUS

(75) Inventors: Jeong S. Kang, Daejeon (KR); Bong J. Cha, Daejeon (KR); Lee K. Ahn, Daejeon (KR)

(73) Assignee: Korea Aerospace Research Institute, Daejeon (KR)

( * ) Notice: Subject to any disclaimer, the term of this patent is extended or adjusted under 35 U.S.C. 154(b) by 679 days.

(21) Appl. No.: 12/341,290

(22) Filed: Dec. 22, 2008

(65) Prior Publication Data

US 2009/0162191 A1 Jun. 25, 2009

(30) Foreign Application Priority Data

Dec. 21, 2007 (KR) ..... 10-2007-0134848

(51) Int. Cl.
*F01B 25/26* (2006.01)
*F01D 25/00* (2006.01)
*F01D 5/00* (2006.01)

(52) U.S. Cl. ..... 415/118; 416/61

(58) Field of Classification Search ..... None
See application file for complete search history.

(56) References Cited

U.S. PATENT DOCUMENTS 3,596,269 A * 7/1971 Laska ..... 340/518
3,985,318 A * 10/1976 Dominey et al. ..... 244/17.11
4,250,745 A * 2/1981 Blatter et al. ..... 73/114.32
4,422,333 A * 12/1983 Leon ..... 73/660
4,457,179 A * 7/1984 Antonazzi et al. ..... 73/701
4,896,537 A * 1/1990 Osborne ..... 73/660
4,934,192 A * 6/1990 Jenkins ..... 73/660
5,205,710 A * 4/1993 Engels et al. ..... 416/61
5,541,857 A * 7/1996 Walter et al. ..... 700/280
5,612,497 A * 3/1997 Walter et al. ..... 73/756
6,629,463 B2 * 10/2003 Naudet et al. ..... 73/579
6,659,712 B2 * 12/2003 Brooks et al. ..... 415/1
6,932,560 B2 * 8/2005 Brooks ..... 415/1
7,108,477 B2 * 9/2006 Grauer ..... 415/1
2003/0007860 A1 * 1/2003 Nakajima et al. ..... 415/1
2007/0245708 A1 * 10/2007 Southwick ..... 60/39.091
2008/0069685 A1 * 3/2008 Bilson ..... 415/118

* cited by examiner

*Primary Examiner* — Scott B Geyer
(74) *Attorney, Agent, or Firm* — Edwards Wildman Palmer LLP

(57) ABSTRACT

Disclosed herein are a turbo-machinery blade breakage monitoring unit and a turbo-apparatus having the same. The blade breakage monitoring unit includes a pressure sensor disposed near a rotor having a plurality of blades to be rotated at a predetermined speed, the pressure sensor functioning to measure total pressures of the respective blades. The blade breakage monitoring unit further includes a controller electrically connected to the pressure sensor and functioning to judge whether or not each measured total pressure value, transmitted from the pressure sensor, is within a preset criterion total pressure range. With the use of the blade breakage monitoring unit, total pressures of the respective blades are monitored in real time at a position downstream of the blades when the blades are rotated at a high speed within the turbo-apparatus, such as a turbine, compressor and fan, enabling real-time monitoring of breakage of the blades.

3 Claims, 3 Drawing Sheets

REAL-TIME TURBOMACHINERY BLADE BREAKAGE MONITORING UNIT AND TURBO-APPARATUS

CROSS-REFERENCE TO RELATED APPLICATION

This application claims under 35 U.S.C. §119(a) the benefit of Korean Patent Application No. 10-2007-134848 filed Dec. 21, 2007, the entire contents of which are incorporated herein by reference.

TECHNICAL FILED

The present invention relates to a turbo-machinery blade breakage monitoring unit and a turbo-apparatus having the same, and, more particularly, to a turbo-machinery blade breakage monitoring unit, which can monitor total pressures of respective blades in real time at a position downstream of the blades when the blades are rotated at a high speed within a turbo-apparatus, such as a turbine, compressor and fan, thereby monitoring breakage of the blade(s), and a turbo-apparatus having the same.

BACKGROUND ART

Typically, turbo-apparatuses, such as compressors, turbines, and fans, include blades to be rotated at a predetermined speed.

For example, a fan has several tens of blades.

Also, in the case of a gas turbine engine, if combustion gas, produced as high-pressure air supplied from a compressor, is burned in a combustion chamber provided in the gas turbine engine, the high-pressure and high-temperature combustion gas is directed into a turbine, thereby being used to rotate a plurality of blades provided in the turbine, a rotating force of the blades being used to generate power.

That is, the gas turbine engine has several thousand blades.

The above-described turbo-apparatuses, such as compressors, turbines, gas or steam turbines and fans, have a feature in that a total pressure downstream of a blade is periodically changed according to rotation of the blade.

Specifically, rotation of a blade causes a pressure wave, similar to a sinusoidal wave, downstream of the blade.

However, when the blade is installed in the turbo-apparatus, it is impossible to easily observe the blade from the outside with the naked eye.

That is, visually observing the interior of the turbo-apparatus has conventionally not been allowed in a state wherein the blade is rotated at a high speed and therefore, there is a problem in that, if any blade is broken in the turbo-apparatus, it is impossible to rapidly recognize the broken blade.

Upon the breakage of any blade, conventional turbo-apparatuses exhibit gradual deterioration in performance. Moreover, broken blades may impair balance of a rotor included in the turbo-apparatus, causing fatal breakage of the entire apparatus.

For this reason, recently, there is a need for a technology to monitor the presence of a broken blade(s) used in a turbo-apparatus in real time.

The above information disclosed in this Background Art section is only for enhancement of understanding of the background of the invention and therefore it may contain information that does not form the prior art that is already known in this country to a person of ordinary skill in the art.

SUMMARY

Therefore, the present invention has been made in view of the above problems, and it is a first object of the present invention to provide a blade breakage monitoring unit, which can monitor total pressures of respective blades in real time at a position downstream of the blades when the blades are rotated at a high speed within a turbo-apparatus, such as a compressor, turbine and fan, and a turbo-apparatus having the same.

It is a second object of the present invention to provide a blade breakage monitoring unit, which can judge the presence of a broken blade(s) when the blades are rotated at a high speed in a turbo-apparatus, thereby preventing breakage and malfunction of the apparatus, and a turbo-apparatus having the same.

In accordance with an aspect of the present invention, the above and other objects can be accomplished by the provision of a turbo-machinery blade breakage monitoring unit including: a pressure sensor disposed near a rotor having a plurality of blades to be rotated at a predetermined speed, the pressure sensor functioning to measure total pressures of the respective blades; and a controller electrically connected to the pressure sensor and functioning to judge whether or not each measured total pressure value, transmitted from the pressure sensor, is within a preset criterion total pressure range.

The controller may be further electrically connected to a display device used to visually display the measured total pressure values and the criterion total pressure range.

The controller may be further electrically connected to an alarm generator used to generate an alarm sound if any one of the measured total pressure values is within the criterion total pressure range.

In accordance with another aspect of the present invention, there is provided a turbo-apparatus comprising: a rotor including a rotating shaft to be rotated upon receiving power from an external source and a plurality of blades radially extending from the rotating shaft by a predetermined length; and a blade breakage monitoring unit disposed near the rotor and functioning to measure total pressures of the respective blades during rotation of the blades, so as to judge whether or not each measured total pressure value is within a preset criterion total pressure range for monitoring breakage of the blades in real time.

The blade breakage monitoring unit may include: a pressure sensor disposed downstream of the blades and functioning to measure the total pressures of the respective blades; and a controller electrically connected to the pressure sensor and functioning to judge whether or not each measured total pressure value, transmitted from the pressure sensor, is within the preset criterion total pressure range.

The controller may be further electrically connected to a display device used to visually display the measured total pressure values and the criterion total pressure range.

The controller may be further electrically connected to an alarm generator used to generate an alarm sound if any one of the measured total pressure values is within the criterion total pressure range.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Now, preferred embodiments of a turbo-machinery blade breakage monitoring unit and a turbo-apparatus having the same according to the present invention will be described with reference to the accompanying drawings.

Figure 1:
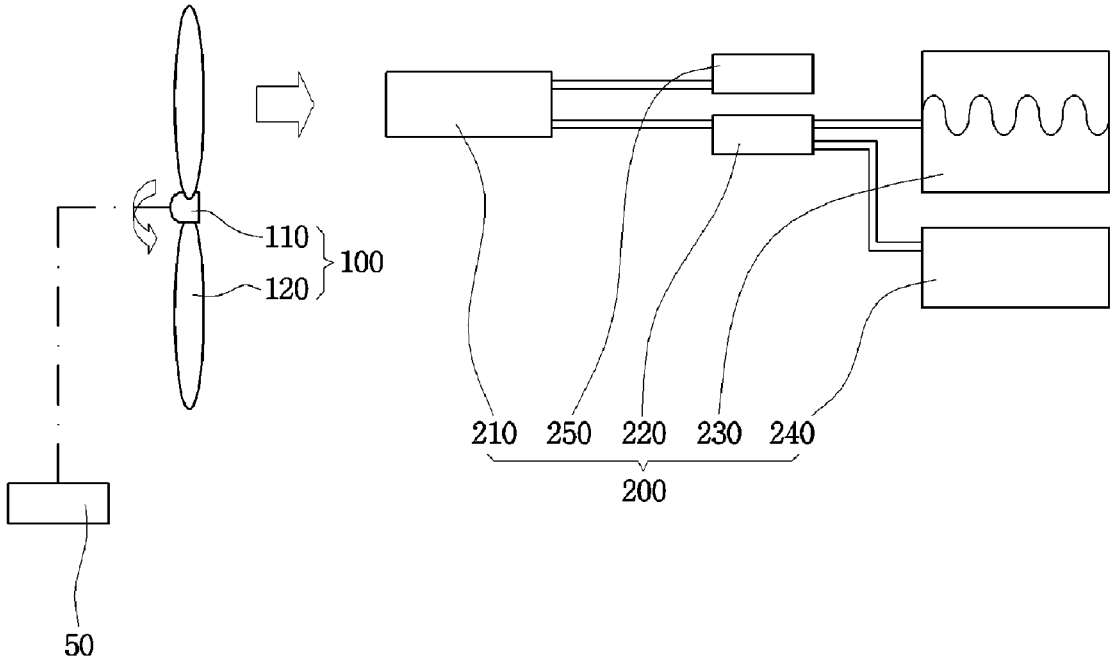
FIG. 1 is a view illustrating a turbo-apparatus having a turbo-machinery blade breakage monitoring unit according to the present invention.
Figure 2:
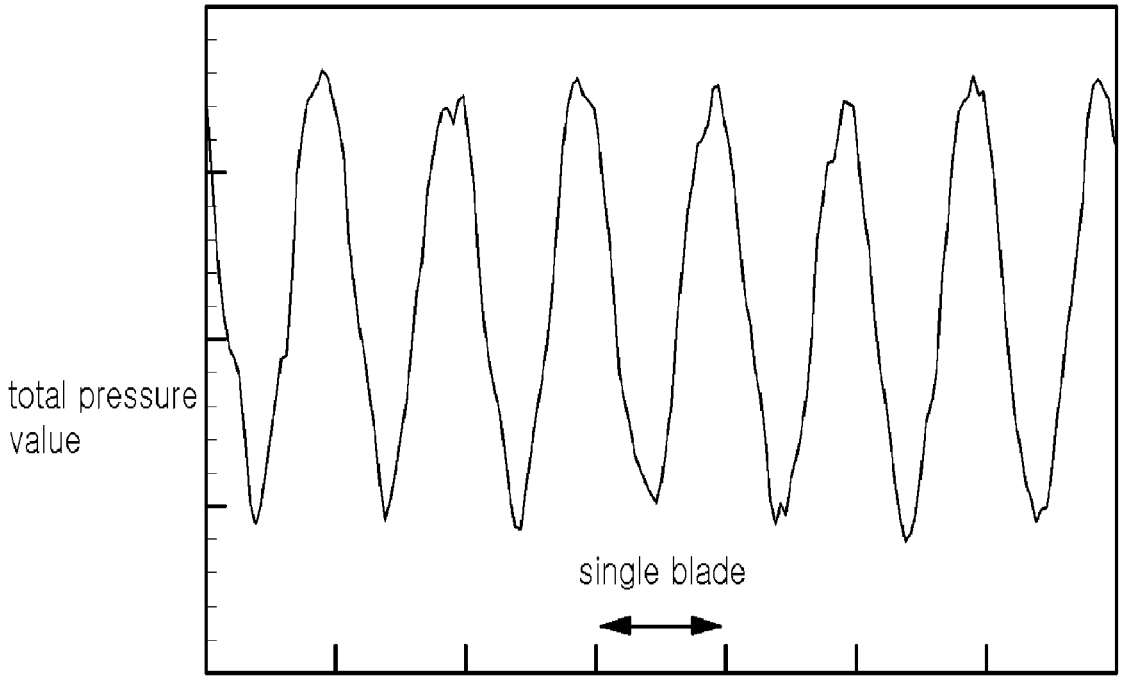
FIG. 2 is a graph illustrating one exemplary values of total pressures measured downstream of turbo-machinery blades shown in FIG. 1.
Figure 3:
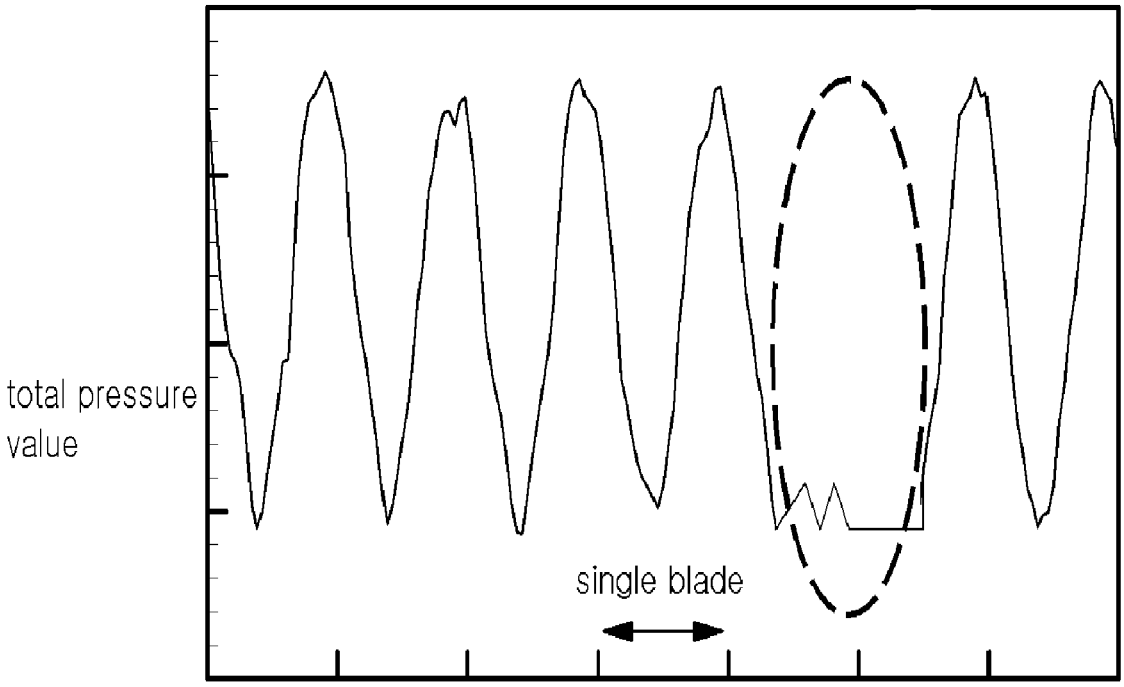
FIG. 3 is a graph illustrating another exemplary values of total pressures measured downstream of turbo-machinery blades shown in FIG. 1.

FIG. 1 is a view illustrating a turbo-apparatus having a turbo-machinery blade breakage monitoring unit according to the present invention. FIG. 2 is a graph illustrating one exemplary values of total pressures measured downstream of turbo-machinery blades shown in FIG. 1. FIG. 3 is a graph illustrating another exemplary values of total pressures measured downstream of turbo-machinery blades shown in FIG. 1.

Referring to FIG. 1, the turbo-apparatus according to the present invention includes a rotor 100, which is adapted to be rotated at a predetermined speed upon receiving power from a motor 50.

The rotor 100 includes a rotating shaft 110, and a plurality of blades 120 radially extending from the rotating shaft 110 by a predetermined length.

The turbo-apparatus further includes a blade breakage monitoring unit 200, which is disposed near the rotor 100 and is capable of monitoring breakage of the blades 120 in real time during rotation of the blades 120.

The blade breakage monitoring unit 200 functions to measure total pressures of the respective rotating blades 120, and to judge whether or not each measured total pressure value is within a preset criterion total pressure range, thereby monitoring breakage of the blades 120 in real time.

More specifically, the blade breakage monitoring unit 200 includes a pressure sensor 210, which is located downstream of the blades 120 and functions to measure total pressures of the respective blades 120, and a controller 220, which is electrically connected to the pressure sensor 210 and functions to judge whether or not each measured total pressure value, transmitted from the pressure sensor 210, is within a preset criterion total pressure range.

The controller 220 may also be electrically connected to a power source 250 to receive power therefrom.

A display device 230 is electrically connected to the controller 220 and is used to visually display the measured total pressure values and the criterion total pressure range.

Also, an alarm generator 240 is electrically connected to the controller 220 and is used to generate an alarm sound if the measured total pressure value is within the criterion total pressure range.

Next, operations and effects of the turbo-apparatus having the blade breakage monitoring unit according to the present invention having the above-described configuration will be described.

Referring to FIG. 1, the rotor 100 is rotated at a predetermined speed upon receiving power from the motor 50.

Simultaneously with rotation of the rotor 100, the plurality of blades 120 linked to the rotating shaft 110 of the rotor 100 is rotated.

During rotation of the blades 120, the blade breakage monitoring unit 200 according to the present invention is able to monitor occurrence of breakage of the blades 120 in real time.

More specifically, the pressure sensor 210, located downstream of the blades 120, measures total pressures of the respective blades 120 during rotation of the blades 120.

The measured total pressure values are transmitted to the controller 220.

The display device 230 displays the measured total pressure values transmitted to the controller 220 in real time. As shown in FIG. 2, the measured total pressure values are represented as a sinusoidal pressure wave.

Then, the controller 220 judges whether or not each measured total pressure value is within a preset criterion total pressure range.

The display device 230 may also display the criterion total pressure range.

FIG. 2 illustrates the case where the measured total pressure values escapes the criterion total pressure value, whereas FIG. 3 illustrates the case where a total pressure value measured at any one of the blades 120 is within the criterion total pressure range.

Specifically, in the case where a total pressure value measured at any one of the blades 120 is within the criterion total pressure range, the controller 220 is able to judge that the corresponding blade 120 included in the criterion total pressure range is broken.

In this case, it will be appreciated as shown in FIG. 3 that the display device 230 displays a total pressure distribution in which the total pressure value of any one of the blades 120 within the criterion total pressure range is comparatively lower than total pressure values of the remaining blades 120.

Upon breakage of any one of the blades 120, the controller 220 also transmits an electric signal to the alarm generator 240.

In response to the electric signal, the alarm generator 240 may emit an alarm sound that informs an operator of breakage of the blade 120.

Accordingly, when the blades 120 are rotated at a high speed in the turbo-apparatus such as a gas or steam turbine, compressor, fan, or the like, it is possible to measure abnormal total pressures (See FIG. 3) of the blades 120 in real time as the blades 120 pass near the pressure sensor 210 located downstream of the blade 120, so as to monitor the presence of the broken blade 120 in real time. The monitoring results can be used to rapidly determine and perform the repair or maintenance of the turbo-apparatus.

As apparent from the above description, the present invention has the effect of monitoring total pressures of respective blades in real time at a position downstream of the blades when the blades are rotated at a high speed within a turbo-apparatus, such as a compressor, turbine and fan.

Further, the present invention has the effect of judging the presence of a broken blade(s) when the blades are rotated at a high speed in an apparatus, thereby preventing breakage and malfunction of the apparatus.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A turbo-machinery blade breakage monitoring system comprising:

a pressure sensor disposed near a rotor having a plurality of blades to be rotated at a predetermined speed, the pressure sensor configured to measure total pressures of each of the blades of the plurality of blades; and a controller electrically connected to the pressure sensor and configured to judge whether or not each measured total pressure value of any one of the blades, transmitted from the pressure sensor, is within a preset criterion total pressure range, wherein when the total pressure of any one of blades within the criterion total pressure range is comparatively lower than the total pressure of each of the remaining blades, the controller determines that blade is broken.

2. The system according to claim 1, wherein the controller is further electrically connected to a display device used to visually display the measured total pressure values and the criterion total pressure range.

3. The system according to claim 1, wherein the controller is further electrically connected to an alarm generator used to generate an alarm sound if any one of the measured total pressure values is within the criterion total pressure range.

* * * * *